US005552698A

United States Patent [19]

Tai et al.

[11] Patent Number: 5,552,698

[45] Date of Patent: Sep. 3, 1996

[54] VOLTAGE SUPPLY SYSTEM FOR IC CHIPS

[75] Inventors: Chiao Y. Tai, Hsin-Chu; Yung L. Chen, Chung-Ho; Chun-Yi Huang, Chung-Hwa, all of Taiwan

[73] Assignee: United Microelectronics Corp., Hsin-Chu, Taiwan

[21] Appl. No.: 496,485

[22] Filed: Jun. 29, 1995

[51] Int. Cl.[6] ..... G05F 3/16

[52] U.S. Cl. ..... 323/313; 327/538

[58] Field of Search ..... 323/312, 313, 323/314; 327/535, 538, 539; 365/226, 227

[56] References Cited

U.S. PATENT DOCUMENTS 4,965,469 10/1990 Kondoh et al. ..... 307/446

5,280,455 1/1994 Kanaishi ..... 365/229

5,349,285 9/1994 Okanobu ..... 323/312

5,483,152 1/1996 Hardee et al. ..... 323/314

*Primary Examiner*—Matthew V. Nguyen

*Attorney, Agent, or Firm*—Barnes, Kisselle, Raisch, Choate, Whittemore & Hulbert P.C.

[57] ABSTRACT

A voltage supply system for use on an IC chip is provided. The system comprises a voltage shifting circuit for transferring an IC chip external input voltage signal range to an operating voltage range of an IC chip internal logic circuit, an IC chip internal logic circuit including low voltage components contributing to major functions of the IC chip, a low voltage signal range to high voltage signal range conversion circuit for stretching the operating voltage signal range of the IC internal logic circuit to an IC chip external output signal range, and a reference potential signal generating circuit for generating reference potential signals.

7 Claims, 3 Drawing Sheets

VOLTAGE SUPPLY SYSTEM FOR IC CHIPS

FIELD OF THE INVENTION

The present invention generally relates to a circuit for voltage conversion for IC chips and more particularly, relates to a voltage conversion circuit for IC chips suitable for generating an operating voltage higher than +3 volts and an operating voltage lower than 0 volt.

BACKGROUND OF THE INVENTION

Among conventional IC chips, a high voltage IC chip is known as having an operating voltage range that exceeds +5 volts. These chips normally have dimensions larger than chips that operate at +5 volts and therefore, the manufacturing cost for the higher voltage IC chips is higher than the cost for the lower voltage chips. However, a conventional voltage conversion circuit for IC chips only operates between a high voltage of +3 volts to +5 volts. Also, it is not capable to convert an operating voltage to a voltage of below 0 volt.

In a conventional voltage conversion circuit for the 3 volts/+5 volts range, a low voltage of the circuit is maintained at 0 volt. In a conventional high voltage IC chip, the input voltage is shifted to the highest output or the lowest output voltage directly at the input interface. In this way, the logic circuit of the high voltage IC chip operates at the highest output or the lowest output voltage. In connection with the large voltage difference between the two voltages, a large area high voltage components must be used at respectively higher manufacturing cost. Furthermore, a conventional +3 volts/+5 volts voltage conversion circuit is limited to a low operating voltage at 0 volt. It cannot be used for a high voltage IC chip that operates at an operating voltage of below 0 volt.

It is therefore an object of the present invention to provide a voltage conversion circuit for IC chips that does not have the drawbacks of conventional voltage conversion circuits.

It is another object of the present invention to provide a voltage conversion circuit for IC chips that provides an operating voltage range of high voltage of higher than +3 volts and low voltage of lower than 0 volt.

It is a further object of the present invention to provide a voltage conversion circuit for IC chips capable of using low voltage components of smaller dimensions.

It is still another object of the present invention to provide a voltage conversion circuit for IC chips that is equipped with a voltage conversion circuit at the input terminal of the IC chip.

It is yet another object of the present invention to provide a voltage conversion circuit for IC chips that provides a low voltage to high voltage conversion circuit as an interface at the output terminal of the IC chip.

It is yet another further object of the present invention to provide a voltage conversion circuit for IC chips that does not occupy a large IC area and does not consume high power.

It is still another further object of the present invention to provide a voltage conversion circuit for IC chips that operates in an operating voltage range of low voltages below 0 volt.

SUMMARY OF THE INVENTION

In accordance with the present invention, a voltage supply system for use on an IC chip is provided. The system comprises four main parts, namely:

a voltage shifting circuit for transferring an IC chip external input voltage signal range confined between a level of a high potential signal and a level of a low potential signal to an operating voltage range of an IC chip internal logic circuit; the operating voltage signal range is confined between a level of the highest positive or a level of the lowest negative potential signal and a level of a corresponding signal of reference potential signals;

an IC chip internal logic circuit including low voltage components contributing to major functions of the IC chip;

a low voltage signal range to high voltage signal range conversion circuit for stretching the operating voltage signal range of the IC internal logic circuit to an IC chip external output signal range confined between the level of the highest positive potential signal and the level of the lowest negative potential signal; and a reference potential signal generating circuit for generating the above-mentioned reference potential signals.

A voltage conversion circuit for IC chips that provides a low operating voltage below 0 volt and utilizes small-dimension low voltage components is provided.

The improved voltage conversion circuit for IC chips is especially suitable for IC chips that have operating voltage of a high voltage higher than 3 volts and a low voltage of lower than 0 volt. The IC chip can be constructed with smaller dimension low voltage components. A voltage conversion circuit is connected to the input terminal, a low voltage to high voltage conversion circuit is connected to the output terminal as an interface such that the manufacturing cost of the chip can be reduced accordingly.

BRIEF DESCRIPTION OF THE DRAWINGS

Other objects, features and advantages of the present invention will become apparent upon consideration of the specification and the appended drawings, in which.

DETAILED DESCRIPTION OF THE PREFERRED EMBODIMENT

The present invention describes a voltage shifting-conversion system for IC chips that can be suitably used in an operating voltage range of higher than +3 volts or lower than 0 volt. When compared to a conventional high voltage IC chip, the present invention enables a saving of area on the IC chip and a reduction in the chip power consumption.

Figure 1:
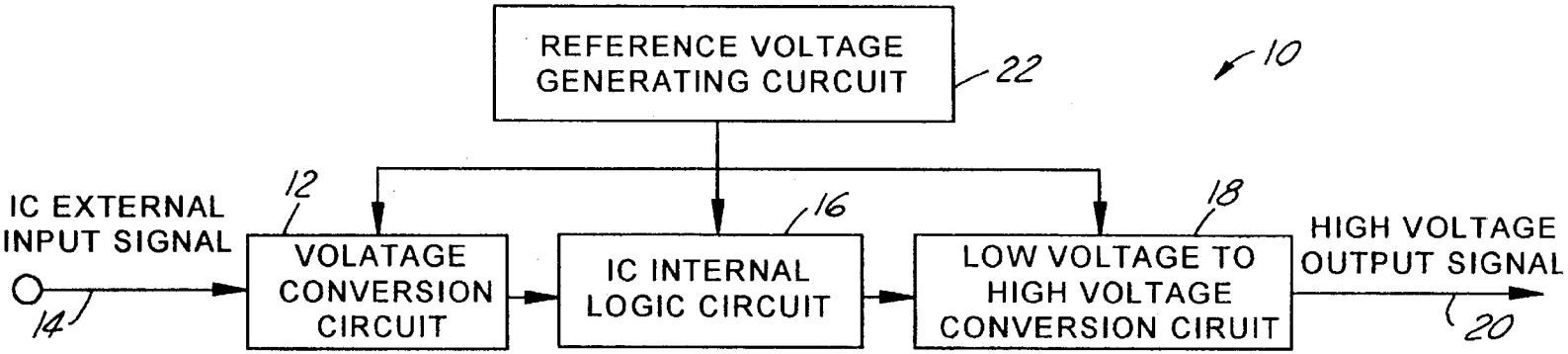
FIG. 1 is a block diagram illustrating a structure of the present invention voltage conversion circuit for IC chips.

Referring initially to FIG. 1, wherein a present invention voltage shifting-conversion system 10 which comprises four major components is shown. The components are a voltage shifting circuit 12 fed by IC external input signals through an input terminal 14, an internal IC logic circuit 16, a low voltage to high voltage conversion circuit 18 producing a high voltage output signal 20, and a reference voltage generating circuit 22. The circuit 12 supplies the internal IC logic circuit 16 with signals shifted into the range compatible with that used by the circuit 16. The low voltage to high voltage conversion circuit 18 converts signals supplied by the circuit 16 into the range compatible with that used by external circuits.

Figure 2:
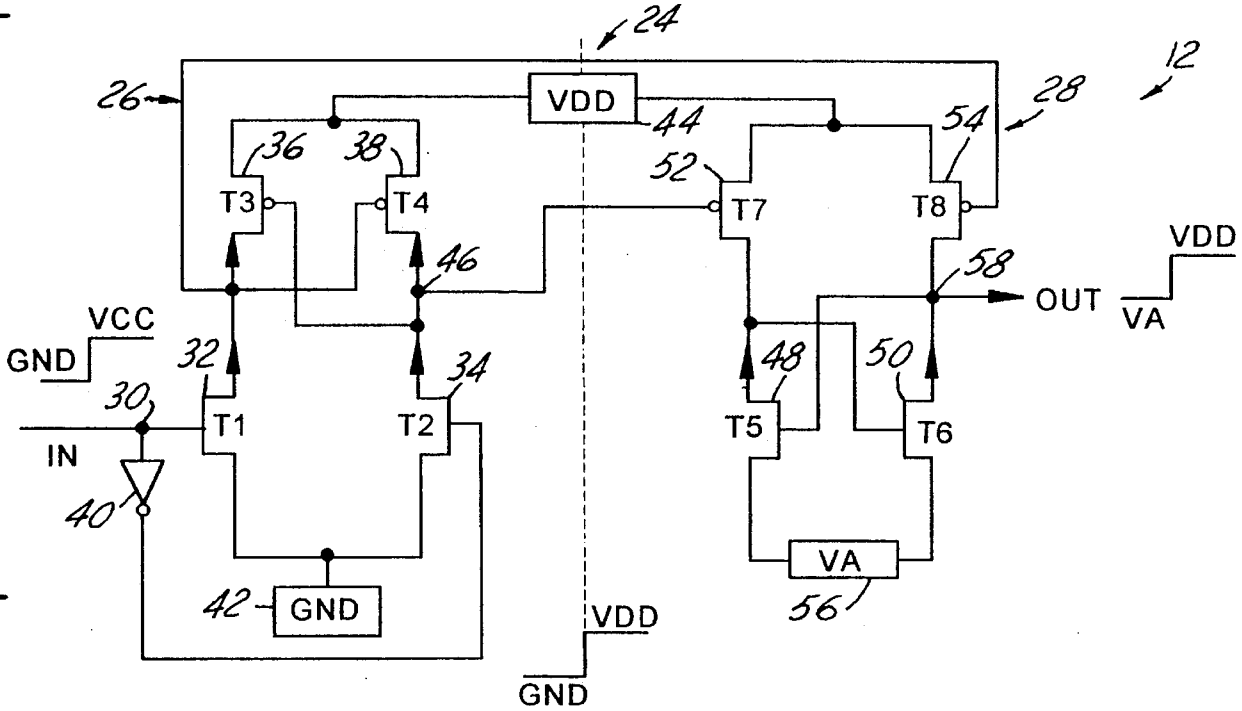
FIG. 2 is a circuit diagram of a circuit for shifting a low positive voltage range to a high positive voltage range in accordance with the present invention.

Referring now to FIG. 2 where a circuit diagram for an embodiment of the voltage shifting circuit 12 is shown. The embodiment of a voltage conversion circuit 24 provides the necessary conversion function between an external IC input operating voltage level and an internal IC logic circuit operating voltage level. The voltage conversion circuit 24 is composed of a first stage 26 and a second stage 28. Input signals are applied to a terminal 30. Four CMOS transistors T1 32, T2 34, T3 36, and T4 38 comprise the first stage level conversion. The input signals are applied to the gate of the NMOS transistor T1 32 directly. They are applied to the gate of the NMOS transistor T2 34 through an inverter 40. There are two potentials feeding the first stage 26, specifically a ground potential GND 42 and a VDD potential 44. A signal at the output of the first stage 26 is sensed at a terminal 46.

Four CMOS transistors T5 48, T6 50, T7 52, and T8 54 comprise the second stage level conversion. There are two potentials feeding the second stage 28, specifically the potential VA 56 and the potential VDD 44. The potential VA 56 is lower than the high potential VI)D 44 of the IC output operating voltage but is higher than the high potential VCC (not shown in FIG. 2) of the IC input operating voltage. A signal at the output of the circuit 24 is sensed at a terminal 58.

The first stage level converter 26 raises an IC external input low voltage VCC to an IC output operating voltage high potential VDD. It may be illustrated as follows. When an input potential at the input terminal 30 of the circuit 26 is VCC, a control potential for the T2 transistor 34 is GND due to the inversion function of the inverter 40 fed by VCC and GND. The T1 transistor 32 turns on while the T2 transistor 34 turns off. When the T1 transistor 32 is "ON", GND 42 is applied to the gate of the T4 transistor 38 and to the gate of the T8 transistor 54 of the second stage 28. The T4 transistor 38 turns on, and the VDD potential 44 is applied to the gate of the T3 transistor 36 of the first stage 26, and to the gate of the T7 transistor 52 of the second stage 28. The T3 transistor 36 and T7 transistor 52 are kept "OFF". In this way, the VCC potential at the input terminal 30 undergoes conversion to the VDD potential at the output terminal 46 of the first stage 26.

Further, as a result of the GND potential 42 being applied to the gate of the T8 transistor 54, the T8 transistor 54 is turned "ON", and the VDD potential 44 is applied to the gate of the T5 transistor 48 to turn it on. The VA potential 56 is applied to the gate of the T6 transistor 50 to keep it "OFF". The VDD potential 44 appears at the output terminal 58.

On the other hand, when an input potential at the input terminal 30 of the circuit 26 is GND, a control potential for the T2 transistor 34 is VCC due to the inverter 40. The T2 transistor 34 turns on while the T1 transistor 32 turns off. Inasmuch as the T2 transistor 34 is "ON", GND 42 is applied to the gate of the T3 transistor 36 and to the gate of the T7 transistor 52 of the second stage 28. The T3 transistor 36 turns on, and the VDD potential 44 is applied to the gate of the T4 transistor 38 of the first stage 26, and to the gate of the T8 transistor 54 of the second stage 28. Both these transistors are kept "OFF". In this way, the GND potential at the input terminal 30 remains unchanged at the output of the first stage 26 (terminal 46).

Further, as a result of the GND potential 42 being applied to the gate of the T7 transistor 52, the latter transistor is turned "ON", and the VDD potential 44 is applied to the gate of the T6 transistor 50 to turn it on. The VA potential 56 is applied to the gate of the T5 transistor 48 to keep it "OFF". At the same time, the VA potential 56 appears at the output terminal 58.

In the described manner, the circuit 24 performs parallel conversion of an operating voltage signal level GND-VCC into another operating voltage signal level VA-VDD. For instance, when the external high input potential VCC is 3 volts, the low potential GND is 0 volt, then the output high potential VDD is 13 volt for the high voltage IC chip, i.e., the voltage shifting circuit of the present invention shifts the input operating voltage of 3 volts to 13 volts. Similarly, if the input voltage is 0 volt it remains unchanged at 0 volt in the first stage. The second stage level converter shifts the input voltage of 0 volt to 10 volts. The potential difference between high and low is then 13–10=3 volt after the two stage level conversion. The 10 volt potential is generated by the fourth component of the present invention, i.e. the reference voltage generating circuit 22 which enables an input of 3 volts to be raised to 13 volts and an input of 0 volt to be raised to 10 volts.

In this way an external input signal is inputted into the circuit 16 through a voltage conversion circuit 12 to execute the major functions of the IC. Since the operating voltage operates at a low voltage manufacturing range, the area used on the IC chip can be saved and the power consumption can be reduced. The more complicated is the present logic circuit, the more area can be saved on the chip. This is one of the objectives of the present invention.

Figure 3:
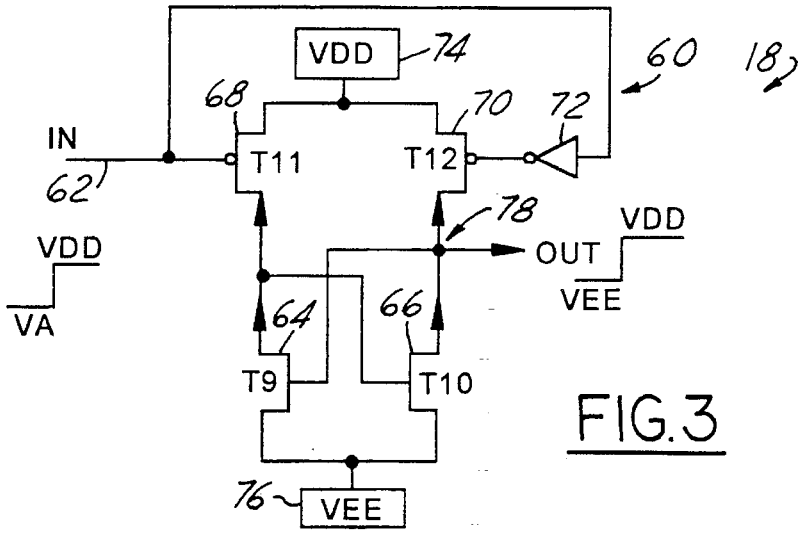
FIG. 3 is a circuit diagram of a circuit for converting a high positive voltage range to a high positive-negative voltage range in accordance with the present invention.

An example of a low voltage to high voltage conversion circuit 18 is shown in FIG. 3. The circuit 60 converts the operating voltage of an IC internal logic circuit 16 to the actual output operating voltage of the IC chip. It shifts a high voltage of the internal logic circuit 16 to a high output voltage of the IC chip, and shifts the low voltage of the IC internal logic circuit to a low voltage of the IC output. The low voltage of the IC output is lower than 0 volt.

Circuit 60 for converting operating voltages of IC internal logic circuit 16 to IC chip output operating voltages has an input terminal 62 and comprises four CMOS transistors, namely T9 and T10 NMOS transistors 64 and 66, respectively, and T11 and T12 PMOS transistors 68 and 70, respectively. Input signals arrive at the gate of T11 transistor 68 directly and at the gate of T12 transistor 70 through inverter 72 fed by VA and VDD potentials. Circuit 60 is fed by a VDD potential 74 and a VEE potential 76. Circuit 60 output potentials are sensed at a terminal 78. In more detail, the process of converting voltages by means of circuit 60 is described as follows.

When a VA potential arrives at the gate of T11 transistor 68 and, consequently, a VDD potential arrives at the gate of T12 transistor 70, T11 transistor 68 turns on and T12 transistor 70 turns off. Through the turned-on T11 transistor 68, VDD potential 74 is applied to the gate of T10 transistor 66 and turns it on. Through the turned-on T10 transistor 66, VEE potential 76 is applied to the output terminal 78 and also keeps T9 transistor 64 in the "OFF" state. On the other hand, when a VDD potential arrives at the gate of T11 transistor 68 and a VA potential is applied to the gate of T12 transistor 70, the T12 transistor 70 turns on and the T11 transistor 68 turns off. Through the turned-on T12 transistor 70, VDD potential 74 is applied to the gate of T9 transistor 64 turning it on and can be sensed at the output terminal 78. Through the turned-on T9 transistor 64, VEE potential 76 is applied to the gate of T10 transistor 66 keeping it in the "OFF" state. In the described manner, the input voltage range of VA-VDD is converted into the output VEE-VDD range.

Figure 6:
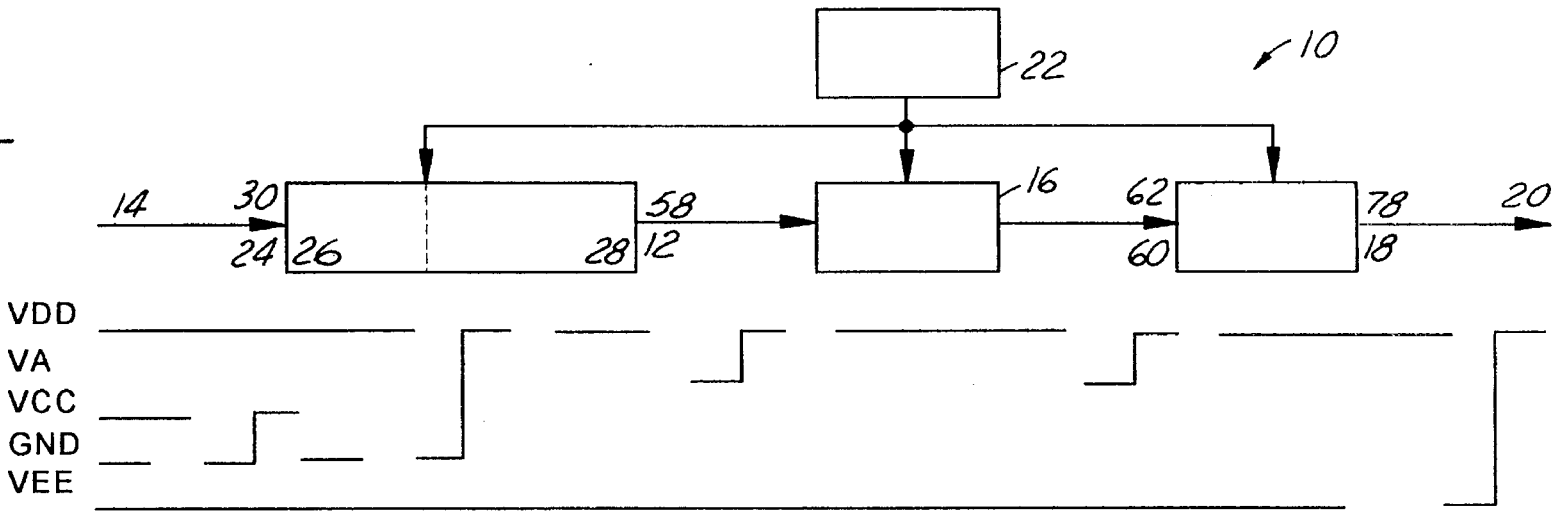
FIG. 6 is a block diagram illustrating a high voltage IC chip and its corresponding voltage relationship for the circuits according to the circuit diagrams shown in FIGS. 2 and 3.

FIG. 6 is a pictorial illustration of signal conversion examples described in FIGS. 2 and 3.

The reference potential generating circuit 22 provides a low potential to the IC internal logic circuit 16. The circuit 22 is known in the art. For example, a conventional bandgap circuit can be employed to this end.

The present invention circuit 10 not only can raise an external input potential, for instance, to raise a 3 volt input to 13 volts and a 0 volt input to 10 volt as shown in the above. By means of an alternative embodiment of circuit 12, it can also drop the potential to a lower voltage. To accomplish this, a voltage conversion circuit 80 is provided.

Figure 4:
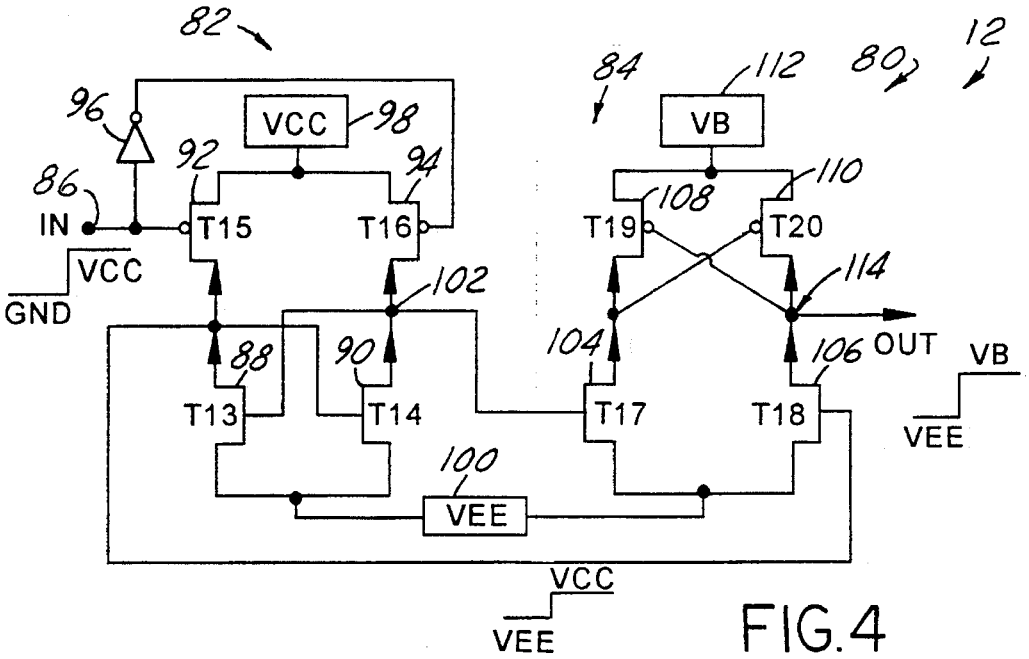
FIG. 4 is a circuit diagram illustrating a circuit according to the present invention for voltage shifting from a low positive voltage range to a high negative voltage range.

Similar to circuit 24, the circuit 80 depicted in FIG. 4 includes a two stage level converter having a first stage 82 and a second stage 84. The first stage level converter decreases the low voltage of an external input to a low voltage of an external output while maintaining the voltage position when the input is a high potential. The second stage level converter will then shift a high voltage input to higher than the lowest voltage of the IC external output, however, lower than the low voltage of the IC external input.

Input signals are sent to terminal 86. Four CMOS transistors T13 88, T14 90, T15 92, and T16 94 operate at the first stage level conversion. The input signals are applied to the gate of the PMOS transistor T15 92 directly. The signals also arrive at the gate of the PMOS transistor T16 94 through an inverter 96. There are two potentials feeding the first stage 82, namely, a low positive potential VCC 98 and a high negative potential VEE 100. A signal at the output of the first stage 82 is detected at a terminal 102.

Four CMOS transistors T17 104, T18 106, T19 108, and T20 110 are used for the second stage level conversion. There are two potentials feeding the second stage 84, specifically a potential VB 112 and a potential VEE 100. The potential VB 112 is higher (less negative) than the high potential VEE 100 of the IC output operating voltage and is lower than the high potential VCC (not shown in FIG. 4) of the IC input operating voltage. A signal at the output of the circuit 80 is detected at a terminal 114.

The first stage level converter 82 lowers an IC external input low voltage GND to an IC output operating voltage high negative potential VEE. In greater detail, it is described as follows. When an input potential at the input terminal 86 of the converter 82 is GND, a control potential for the T16 transistor 94 is VCC due to the inversion function of the inverter 96 fed by VCC and GND. The T15 transistor 92 turns on while the T16 transistor 94 turns off. When the T15 transistor 92 is "ON", VCC 98 is applied to the gate of the T14 transistor 90 and to the gate of the T18 transistor 106 of the second stage converter 84. The T14 transistor 90 turns on, and the VEE potential 100 is applied to the gate of the T13 transistor 88 of the first stage 82, and to the gate of the T17 transistor 104 of the second stage 84. The T13 transistor 88 and T17 transistor 104 are kept "OFF". In this way, the GND potential at the input terminal 86 converts to the VEE potential at the output terminal 102 of the first stage converter 82.

Further, as a result of the VCC potential 98 arriving at the gate of the T18 transistor 106, the T18 transistor 106 is turned "ON", and the VEE potential 100 is applied to the gate of the T19 transistor 108 to turn it on. The VB potential 112 is applied to the gate of the T20 transistor 110 to keep it "OFF". The VEE potential 100 appears at the output terminal 114.

On the other hand, when an input potential at the input terminal 86 of the circuit 80 is VCC, a control potential for the T16 transistor 94 is GND due to the inverter 96. The T16 transistor 94 turns on while the T15 transistor 92 turns off. Since the T16 transistor 94 is "ON", VCC 98 is applied to the gate of the T13 transistor 88 and to the gate of the T17 transistor 104 of the second stage 84. The T13 transistor 88 turns on, and the VEE potential 100 is applied to the gate of the T14 transistor 90 of the first stage 82, and to the gate of the T18 transistor 106 of the second stage 84. Both these transistors are kept "OFF". In this way, the VCC potential at the input terminal 86 remains unchanged at the output of the first stage 82 (terminal 102).

Further, by applying the VCC potential 98 to the gate of the T17 transistor 104, the latter transistor is turned "ON". The FEE potential 100 is applied to the gate of the T20 transistor 110 and switches the transistor 110 on. The VB potential 112 is applied to the gate of the T19 transistor 108 to keep it "OFF". At the same time, the VB potential 112 appears at the output terminal 114.

In the above described manner, the circuit 80 performs parallel conversion of an operating voltage signal level GND-VCC into another operating voltage signal level VEE-VB. In this way, an external input signal is inputted into the circuit 16.

Figure 5:
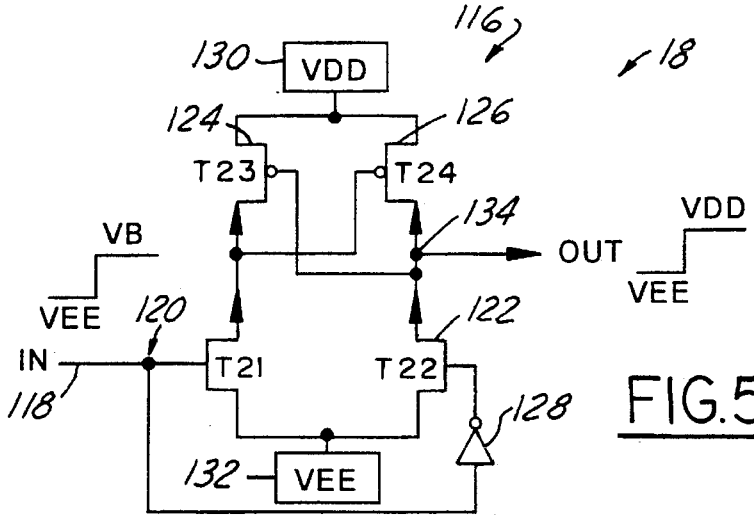
FIG. 5 is a circuit diagram of a circuit for converting a high negative voltage range to a high positive-negative voltage range in accordance with the present invention.

An alternative embodiment of a low voltage to high voltage conversion circuit 18 which shifts the above described operating voltage to the potential of the IC external output is shown in FIG. 5. The embodiment designated in FIG. 5 as circuit 116 converts the operating voltage of an IC internal logic circuit 16 through the use of circuit 80 to the actual output operating voltage of the IC chip. It converts a high voltage of the internal logic circuit 16 to a high output voltage of the IC chip, and shifts the low voltage of the IC internal logic circuit to a low voltage of the IC output. The low voltage of the IC output is lower than 0 volt.

Circuit 116 for converting operating voltages of IC internal logic circuit 16 to IC chip output operating voltages has an input terminal 118 and comprises four CMOS transistors, namely T21 and T22 NMOS transistors 120 and 122, respectively, and T23 and T24 PMOS transistors 124 and 126, respectively. Input signals arrive at the gate of T21 transistor 120 directly and at the gate of T22 transistor 122 through inverter 128 fed by VEE and VB potentials. Circuit 116 is fed by a VDD potential 130 and a VEE potential 132. Circuit 116 output potentials are detected at terminal 134. In greater detail, the process of converting voltages by means of circuit 116 can be set forth as follows.

When a VEE potential arrives at the gate of T21 transistor 120 and a VB potential arrives at the gate of T22 transistor 122, respectively, T21 transistor 120 turns off and T22 transistor 122 turns on. Through the turned-on T22 transistor 122, VEE potential 132 is applied to the gate of T23 transistor 124 and turns it on. At the same time, through the turned-on T22 transistor 112, VEE potential 132 is applied to the output terminal 134 and also keeps T21 transistor 120 in the "OFF" state.

On the other hand, when a VB potential arrives at the gate of T21 transistor 120 that causes the VEE potential to be applied to the gate of T22 transistor 122, the T21 transistor 120 turns on and the T22 transistor 122 turns off. Through the turned-on T21 transistor 120, the VEE potential 132 is applied to the gate of T24 transistor 126 to turn it on. Through the turned-on T24 transistor 126, VDD potential 130 is applied to the gate of T23 transistor 124 to keep it in the "OFF" state which can be detected at the output terminal 134. In the above described method, the input VB-VDD voltage range is converted into the output VEE-VDD voltage range.

Figure 7:
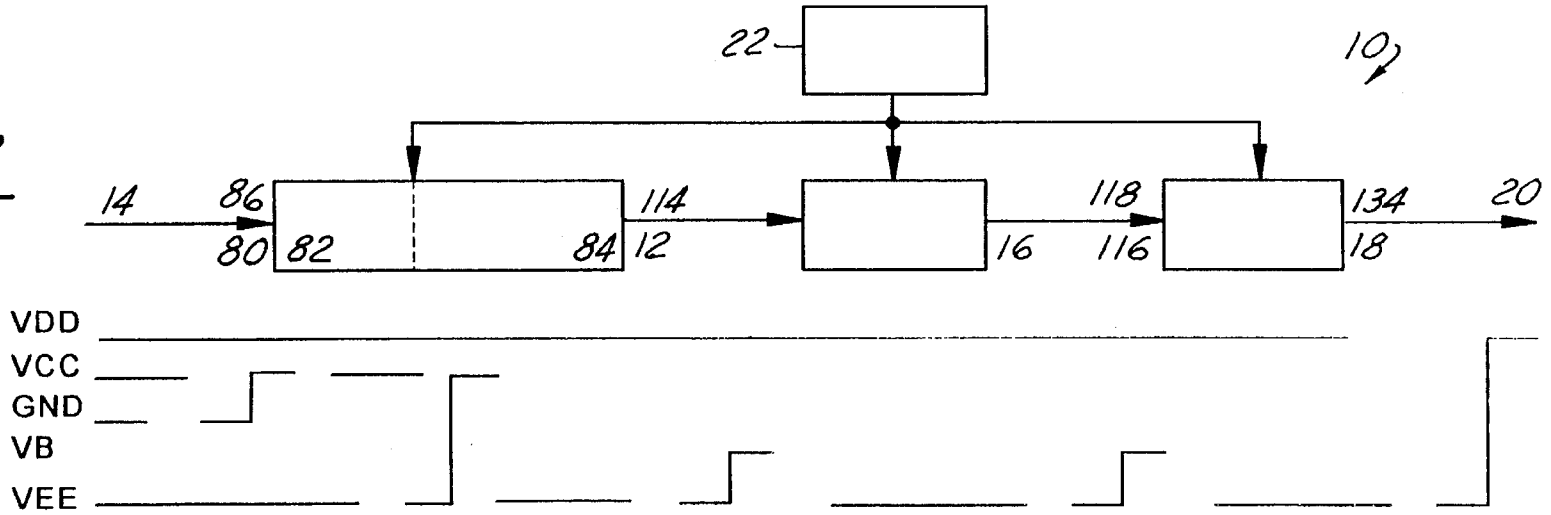
FIG. 7 is a block diagram illustrating a high voltage IC chip and its corresponding voltage relationship for the circuits according to the circuit diagrams shown in FIGS. 4 and 5.

FIG. 7 is a pictorial illustration of signal conversion examples described in FIGS. 4 and 5.

It can be appreciated that the VDD is the highest positive potential signal of the IC external output, VEE is the lowest negative potential signal of the IC external output. The VCC is a high voltage of the IC external input, the GND is a low voltage of the IC external input. The VA and VB are the output direct current voltages of the reference potential signal generating circuit.

While the present invention has been described in an illustrative manner, it should be understood that the terminology used is intended to be in a nature of words of description rather than of limitation.

Furthermore, while the present invention has been described in terms of several embodiments thereof, it is to be appreciated that those skilled in the art will readily apply these teachings to other possible variations of the invention.

The embodiments of the invention in which an exclusive property or privilege is claimed are defined as follows:

1. A voltage supply system for use on an IC chip comprising:

a voltage shifting circuit for transferring an IC chip external input voltage signal range confined between a level of a first high potential signal and a level of a second low potential signal to an operating voltage range of an IC chip internal logic circuit, said operating voltage signal range being confined between a level of a third highest positive or a level of a fourth lowest negative potential signal and a level of a corresponding signal of reference potential signals, said IC chip internal logic circuit including low voltage components contributing to major functions of said IC chip, a low voltage signal range to high voltage signal range conversion circuit for stretching said operating voltage signal range of said IC internal logic circuit to an IC chip external output signal range confined between said level of a highest positive potential signal and said level of a lowest negative potential signal, and a reference potential signal generating circuit for generating said reference potential signals.

2. The voltage supply system for use on an IC chip as claimed in claim 1, wherein said voltage shifting circuit includes a first and a second stages, said first stage expanding said input voltage signal range to an intermediate stretched voltage signal range confined between said level of a second low potential signal and said level of a third highest positive potential signal, and said second stage compressing said intermediate stretched voltage signal range to said operating voltage signal range of an IC chip internal logic circuit confined between said level of a third highest positive potential signal and a level of one of said reference potential signals.

3. The voltage supply system for use on an IC chip as claimed in claim 2, wherein said first stage includes a first and a second transistors of one type of conductivity, a third and a fourth transistors of another type of conductivity, and a first inverter, whereas said second stage includes a fifth and a sixth transistors of said one type of conductivity, and a seventh and an eighth transistors of said another type of conductivity, control electrodes of said first and said second transistors being connected, for said first transistor directly and for said second transistor via said first inverter, to an input terminal of said voltage shifting circuit, output electrodes of said first and said third transistors being connected to control electrodes of said fourth and said eighth transistors, output electrodes of said second and said fourth transistors being connected to control electrodes of said third and said seventh transistors, output electrodes of said fifth and said seventh transistors being connected to a control electrode of said sixth transistor, output electrodes of said sixth and said eighth transistors being connected to a control electrode of said fifth transistor and to an output terminal of said voltage shifting circuit, said first inverter being fed by said first high and said second low potential signals, said first and said second transistors being fed by said second low potential signal, said third, said fourth, said seventh and said eighth transistors being fed by said third highest positive potential signal, and said fifth and said sixth transistors being fed by said one of said reference potential signals.

4. The voltage supply system for use on an IC chip as claimed in claim 2, wherein said low voltage signal range to high voltage signal range conversion circuit includes a ninth and a tenth transistors of one type of conductivity, an eleventh and a twelfth transistors of another type of conductivity, and a second inverter, control electrodes of said eleventh and said twelfth transistors being connected, for said eleventh transistor directly and for said twelfth transistor via said second inverter, to an input terminal of said low voltage signal range to high voltage signal range conversion circuit, output electrodes of said ninth and said eleventh transistors being connected to a control electrode of said tenth transistor, output electrodes of said tenth and said twelfth transistors being connected to a control electrode of said ninth transistor and to an output terminal of said low voltage signal range to high voltage signal range conversion circuit, said second inverter being fed by said third highest positive potential signal and said one of said reference potential signals, said ninth and said tenth transistors being fed by said fourth lowest negative potential signal, and said eleventh and said twelfth transistors being fed by said third highest positive potential signal.

5. The voltage supply system for use on an IC chip as claimed in claim 1, wherein said voltage shifting circuit includes a first and a second stages, said first stage expanding said input voltage signal range to an intermediate stretched voltage signal range confined between said level of a first high potential signal and said level of a fourth lowest negative potential signal, and said second stage compressing said intermediate stretched voltage signal range to said operating voltage signal range of an IC chip internal logic circuit confined between said level of a fourth lowest negative potential signal and a level of another of said reference potential signals.

6. The voltage supply system for use on an IC chip as claimed in claim 5, wherein said first stage includes a thirteenth and a fourteenth transistors of one type of conductivity, a fifteenth and a sixteenth transistors of another type of conductivity, and a third inverter, whereas said second stage includes a seventeenth and a eighteenth transistors of said one type of conductivity, and a nineteenth and a twentieth transistors of said another type of conductivity, control electrodes of said fifteenth and said sixteenth transistors being connected, for said fifteenth transistor directly and for said sixteenth transistor via said third inverter, to an input terminal of said voltage shifting circuit, output electrodes of said thirteenth and said fifteenth transistors being connected to control electrodes of said fourteenth and said eighteenth transistors, output electrodes of said fourteenth and said sixteenth transistors being connected to control electrodes of said thirteenth and said seventeenth transistors, output electrodes of said seventeenth and said nineteenth transistors being connected to a control electrode of said twentieth transistor, output electrodes of said eighteenth and said twentieth transistors being connected to a control electrode of said nineteenth transistor and to an output terminal of said voltage shifting circuit, said third inverter being fed by said first high and said second low potential signals, said fifteenth and said sixteenth transistors being fed by said first high potential signal, said thirteenth, said fourteenth, said seventeenth and said eighteenth transistors being fed by said fourth lowest negative potential signal, and said nineteenth and said twentieth transistors being fed by said another of said reference potential signals.

7. The voltage supply system for use on an IC chip as claimed in claim 5, wherein said low voltage signal range to high voltage signal range conversion circuit includes a twenty first and a twenty second transistors of one type of conductivity, a twenty third and a twenty fourth transistors of another type of conductivity, and a fourth inverter, control electrodes of said twenty first and said twenty second transistors being connected, for said twenty first transistor directly and for said twenty second transistor via said fourth inverter, to an input terminal of said low voltage signal range to high voltage signal range conversion circuit, output electrodes of said twenty first and said twenty third transistors being connected to a control electrode of said twenty fourth transistor, output electrodes of said twenty second and said twenty fourth transistors being connected to a control electrode of said twenty third transistor and to an output terminal of said low voltage signal range to high voltage signal range conversion circuit, said fourth inverter being fed by said fourth lowest negative potential signal and said another of said reference potential signals, said twenty first and said twenty second transistors being fed by said fourth lowest negative potential signal, and said twenty third and said twenty fourth transistors being fed by said third highest positive potential signal.

* * * * *